US007303492B2

(12) United States Patent
Aoyama et al.

(10) Patent No.: US 7,303,492 B2
(45) Date of Patent: Dec. 4, 2007

(54) GOLF BALL DIMPLES FORMING INDICIA

(75) Inventors: Steven Aoyama, Marion, MA (US); William E. Morgan, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 217 days.

(21) Appl. No.: 11/191,338

(22) Filed: Jul. 28, 2005

(65) Prior Publication Data

US 2007/0026971 A1 Feb. 1, 2007

(51) Int. Cl.
*A63B 37/12* (2006.01)

(52) U.S. Cl. ..... 473/383

(58) Field of Classification Search ..... 473/383–385
See application file for complete search history.

(56) References Cited

U.S. PATENT DOCUMENTS 2,002,847 A * 5/1935 Atti ..... 101/381

OTHER PUBLICATIONS

The Golf Ball Bool, pp. 47, 54, 55, 67, and 90.

* cited by examiner

*Primary Examiner*—Raeann Trimiew

(57) ABSTRACT

A golf ball comprising an outer surface including a plurality of dimples that form indicia. The plurality of dimples take the form of text letters, characters or other symbols and are relatively similar in size to a plurality of conventional shaped dimples or larger. The plurality of dimples occupy a substantial portion of the ball's surface in a repeating, distributed pattern.

15 Claims, 4 Drawing Sheets

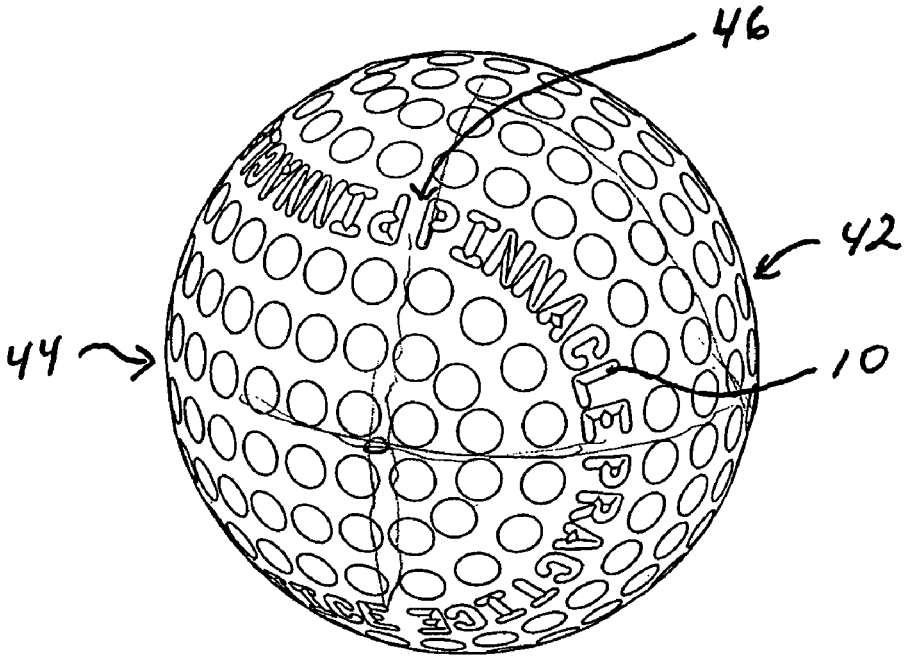
Figure 5
Figure 6
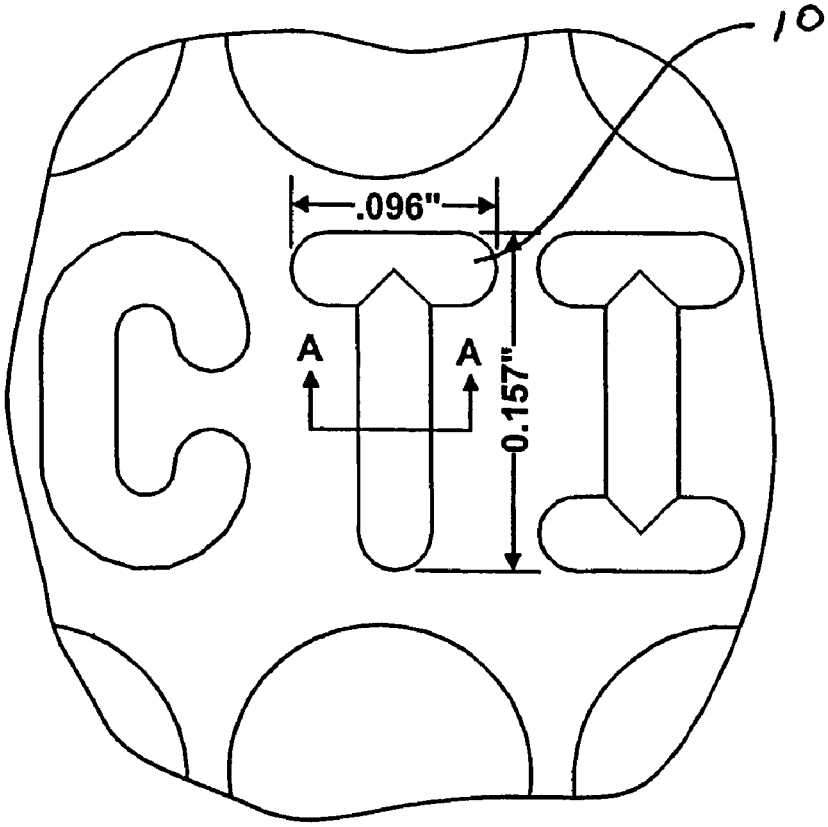

Section A-A

Section A-A

GOLF BALL DIMPLES FORMING INDICIA

FIELD OF THE INVENTION

The present invention relates to golf balls and more particularly, the invention is directed to improved golf balls having a plurality of dimples forming indicia.

BACKGROUND OF THE INVENTION

During the first half of the $20^{th}$ century it was a common practice to mold the brand name of a golf ball directly into the ball's outer surface either as raised or recessed text. If recessed, it was sometimes paint-filled to increase visibility. This type of text was small, characters typically less than 0.010" in height, and occupied a small portion of the ball's surface in a small area on each pole. The area was typically a small rectangular patch containing the name in a single line of text, or a circular patch of ½" diameter or less. In either case, the patch typically occupied only about 5% or less of the ball's total surface area. In reality, these were not dimples at all; they were merely a way of identifying the ball type at a time when modern printing techniques and durable inks were not available. They were too small, too fine, and too few to provide the aerodynamic function that dimples provide.

SUMMARY OF THE INVENTION

The invention comprises a golf ball with a plurality of dimples that take the form of text letters, characters or other symbols as opposed to the circles, polygons, and other shapes that are typically found in the prior art. The present invention relates to indented text that preferably has large and deep features that are comparable in size to conventional golf ball dimples or larger. The text-shaped dimples preferably occupy a substantial portion of the ball's surface in a repeating, distributed pattern. These text-shaped indentations perform at least some of the aerodynamic functions of conventional dimples, in addition to serving cosmetic and identification functions. For identification, they exhibit substantial durability advantages over conventional printed markings, which is especially advantageous for balls used at practice ranges.

In a preferred embodiment, the text-like dimples can have a reduced aerodynamic efficiency that can be used to reduce a golf ball's flight distance, e.g., the golf ball can have a greater coefficient of drag than a standard golf ball. This can be beneficial for practice ranges that have limited space.

The text-shaped depressions are arranged on the surface of the golf ball, preferably in combination with conventional dimples. The letters or other characters may be any suitable size, but are preferably about the size of conventional dimples, about 0.08 to 0.2 inches in height. The deepest parts of the text-shaped depressions are preferably about 0.005 to 0.01 inches below the phantom surface of the ball, but if the purpose is not aerodynamic, they may be shallower or deeper.

Since the text-shaped dimples can have aerodynamic characteristics that are different from those of conventional dimples, it is preferable that they be distributed in a relatively uniform fashion over the surface of the ball. This will assist in maintaining symmetrical and consistent flight performance. However, since it is preferable that the text-shaped dimples be arranged in words or indicia in order to have meaning, it is usually not satisfactory to simply scatter them over the ball's surface. In a preferred embodiment, the text-shaped dimples are strung together into words that form the boundaries of polygonal groupings of conventional dimples. Thus, a preferred embodiment includes words or strings of indicia forming dimples forming polygonal shapes on the surface of the ball with more conventional shaped dimples therein. In a more preferred embodiment, the text-shaped dimples form words delineating the boundaries of the triangular groupings that make up an octahedron based dimple pattern with round or polygonal-shaped dimples therein.

In another preferred embodiment, the text shaped dimples can form words that in turn form the boundaries of half of the triangular groupings, while the other half are made up entirely of conventional dimples. In either case, the text-shaped dimples are uniformly and symmetrically distributed around the ball.

Preferably, the text-shaped dimples are distributed such that they produce little or no effect on the symmetry of ball flight.

In yet another embodiment, the dimple pattern is based on a pentagonal dipyramid. In this form, the hemispheres of the ball can be divided into five isosceles triangles with their bases along the equator and their opposite vertices at the poles. The triangles are preferably delineated by words made up of strings of text-shaped dimples, but in this case each triangle can have its own string along the equator side, and can share a string with neighboring triangles along the other two sides.

Other dimple arrangement schemes may employ groupings that are polygons other than triangles, such as squares, pentagons, or hexagons. For example, a dimple pattern based on a dodecahedron will usually have pentagonal groupings, and one based on a cuboctahedron will usually use a combination of squares and triangles. The same technique of distributing the text-shaped dimples can be applied in these cases, where the text-like dimples are strung into words that form boundaries for these polygons.

However, it is not necessary that the words form the boundaries of polygonal groupings of dimples. Alternative embodiments can have the text-shaped dimples in many different configurations. In one embodiment, which is based on a pentagonal dipyramid structure, the strings of text-shaped dimples can be arranged in latitudinal rows parallel to the equator.

Other embodiments can be based on a pattern that is not based on a polyhedron at all. For example, the surface of the ball can be divided into two identical elongated areas, very much like the pieces that make up the cover of a baseball or tennis ball. The text-shaped dimples can then be strung together into words along the curved path that makes up the "seam" between the two cover "pieces". This provides a symmetrical and uniform distribution of the text-shaped dimples. To create even more text, the same basic design can be used with more than one row of text-shaped dimples.

The text-shaped dimples of the present invention are preferably large enough to be noticeable and easily read, but since they comprise physical depressions in the surface of the ball, they will not be removed by normal wear. For even greater visibility, the depressed areas of the text-shaped dimples can be filled with ink or paint, which will be protected from wear.

BRIEF DESCRIPTION OF THE DRAWINGS

In the accompanying drawings which form a part of the specification and are to be read in conjunction therewith:

FIG. 5 is a golf ball with a plurality of text-shaped dimples forming indicia forming an elongated, curved path on the surface;

FIG. 6 is a blown up view of a text-shaped dimple;

DETAILED DESCRIPTION OF THE INVENTION

The invention comprises golf ball dimples that take the form of text letters, characters or other symbols as opposed to the circles, polygons, and other shapes that are typically found in the prior art. The present invention relates to larger and deeper text-shaped features that are comparable in size to conventional golf ball dimples or larger. The text-shaped dimples preferably occupy a substantial portion of the ball's surface in a repeating, distributed pattern. These text-shaped features also perform at least some of the aerodynamic functions of conventional dimples, in addition to serving cosmetic and identification functions. For identification, they exhibit substantial durability advantages over conventional printed markings, which is especially advantageous for balls used at practice ranges. Golf balls that are used on practice ranges are subjected to hundreds or thousands of hits as they are used over and over. These balls are usually provided with printed or painted markings to identify them as "range" or "practice" balls and to discourage theft. The accumulated abrasion of the repeated hits will eventually remove these markings.

The present invention is directed to text-shaped dimples that are large enough to be noticeable and easily read, but since they comprise physical depressions in the surface of the ball, they will not be removed by normal wear and can be very advantageous for use on practice ranges.

Many practice ranges have limited space that is not large enough to allow for the complete flight of a golf ball for players who hit the ball a long distance. For these ranges, a ball with reduced flight distance is appropriate. Since text-shaped dimples can be designed to be less effective than conventional dimples in reducing the aerodynamic drag and increasing the aerodynamic lift on the ball, they can assist in providing this reduced flight distance.

Text-shaped depressions are arranged on the surface of the golf ball, preferably in combination with conventional dimples. The letters or other characters may be any suitable size, but are preferably about the size of conventional dimples, about 0.08 to 0.2 inches in height. The deepest parts of the depressions are preferably about 0.005 to 0.01 inches below the phantom surface of the ball, but they may be shallower to increase drag. They may also be deeper, but this may reduce the impact durability of the golf ball's cover.

Since the text-like dimples are likely to have aerodynamic characteristics that are different from those of conventional dimples, it is preferable that the text-shaped dimples be distributed in a relatively uniform fashion over the surface of the ball. This will assist in maintaining symmetrical and consistent flight performance. However, since the text-shaped dimples are preferably arranged in words in order to have meaning, it is usually not satisfactory to simply scatter them over the ball's surface.

Figure 1:
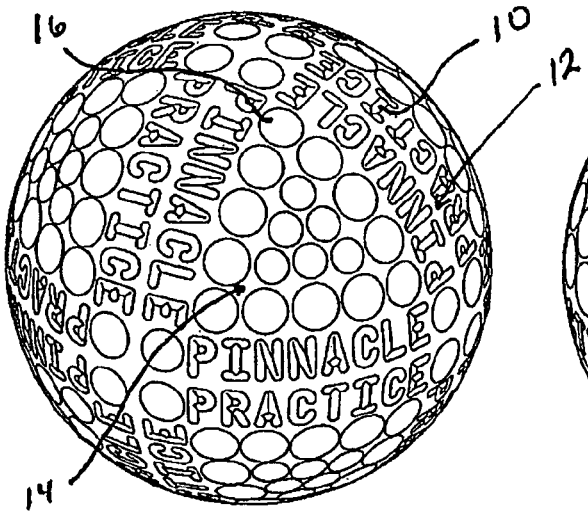
FIG. 1 is a golf ball with a plurality of text-shaped dimples forming indicia that is the boundaries of an octahedron dimple pattern.

In a preferred embodiment, the text-shaped dimples are strung together into words that form the boundaries of polygonal groupings of conventional dimples, as in FIG. 1. In this example, the text-shaped dimples 10 form words delineating the boundaries 12 of the triangular groupings 14 that make up an octahedron based dimple pattern. Round dimples 16, or other shapes, are located within the boundaries formed by the text-shaped dimples 10. The round dimples 16 can be uniform in diameter and depth or can be varied into groups of sizes to improve dimple packing and change aerodynamic properties.

Figure 2:
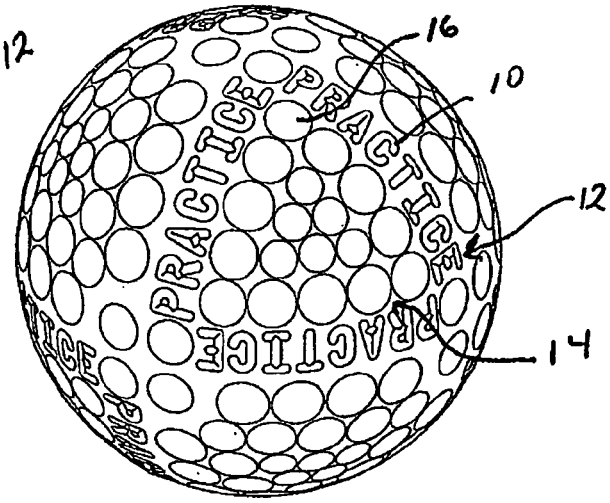
FIG. 2 is a golf ball with a plurality of text-shaped dimples forming indicia that is a portion of the boundaries of an octahedron dimple pattern.

A somewhat different embodiment is shown in FIG. 2. In this case, the text-shaped dimples 10 form words that form the boundaries 12 of only half of the triangular groupings, while the other half are made up entirely of conventional dimples 16. In either case, the text-shaped dimples 10 are uniformly and symmetrically distributed around the ball, producing little or no effect on the symmetry of ball flight.

Table 1 below shows the flight conditions of a standard Practice ball (Comparative ball) compared to two embodiments of balls having a dimple pattern substantially similar to that shown in FIG. 1. The lower CoR of the inventive Example 1 and Example 2 balls were used to limit the flight to determine the effects of reduced flight balls for shorter ranges.

TABLE 1

| Spin 2005035 | Launch Conditions | | | Calculated Trajectory | | | | | |
|---|---|---|---|---|---|---|---|---|---|
| Name | Speed | Angle | Back Spin | Carry | Total | Flight Time | Max Ht. | Dist.@Max Ht. | Imp Ang. |
| Comparative: (0.800 CoR) | | | | | | | | | |
| PP | 161 | 9 | 3390 | 259.8 | 268.5 | 6.99 | 33.2 | 177.5 | 41.0 |
| PH | 161 | 9 | 3390 | 263.4 | 272.1 | 7.1 | 32.7 | 180.2 | 40.6 |
| average | | | | 261.6 | 270.3 | 7.0 | 33.0 | 178.9 | 40.8 |
| Example 1: (0.664 CoR) | | | | | | | | | |
| PP | 151.7 | 8.6 | 3259 | 231.7 | 242.6 | 6.07 | 24.2 | 156.5 | 35.6 |
| PH | 151.7 | 8.6 | 3259 | 231.4 | 243.4 | 5.91 | 22.4 | 153.5 | 33.0 |
| average | | | | 231.6 | 243.0 | 6.0 | 23.3 | 155.0 | 34.3 |

TABLE 1-continued

| Spin 2005035 | Launch Conditions | | | Calculated Trajectory | | | | | |
|---|---|---|---|---|---|---|---|---|---|
| Name | Speed | Angle | Back Spin | Carry | Total | Flight Time | Max Ht. | Dist.@Max Ht. | Imp Ang. |
| Example 2: (0.780 CoR) | | | | | | | | | |
| PP | 158.6 | 9.1 | 3138 | 245.6 | 255.8 | 6.39 | 27.7 | 166.4 | 37.8 |
| PH | 158.6 | 9.1 | 3138 | 245.9 | 257.2 | 6.2 | 25.8 | 163.7 | 35.3 |
| average | | | | 245.7 | 256.5 | 6.3 | 26.8 | 165.1 | 36.5 |

Table 1 shows that the text-shaped dimpled golf ball can have very symmetrical flight characteristics. For example, the flight time for pole-over-pole (PP) is substantially similar to the flight time for pole-horizontal (PH). The flight times were all within 5% of the average. Similarly, the flight maximum heights were all within 5% of the average. Also, the overall carry of the balls were almost identical for PP and PH and certainly within 2% of the average. Thus, the inventive balls exhibited very good symmetry characteristics.

For a standard flight ball embodiment, the preferred coefficients of lift and drag are about 0.16 to 0.18 and about 0.22 to 0.23, respectively, at a Reynolds number of 190,000 and a spin rate of 3000 rpm. However, as set forth above, it may be advantageous to reduce the flight distances for certain embodiments. For these cases, it is preferred to have a coefficient of drag that is between about 0.23 and 0.26 for a Reynolds number of 190,000 and a spin rate of 3000 rpm, and more preferably between about 0.24 and 0.25. For the same conditions though, the coefficient of lift is preferably between about 0.15 and 0.19, and more preferably between about 0.16 and 0.18.

Figure 3:
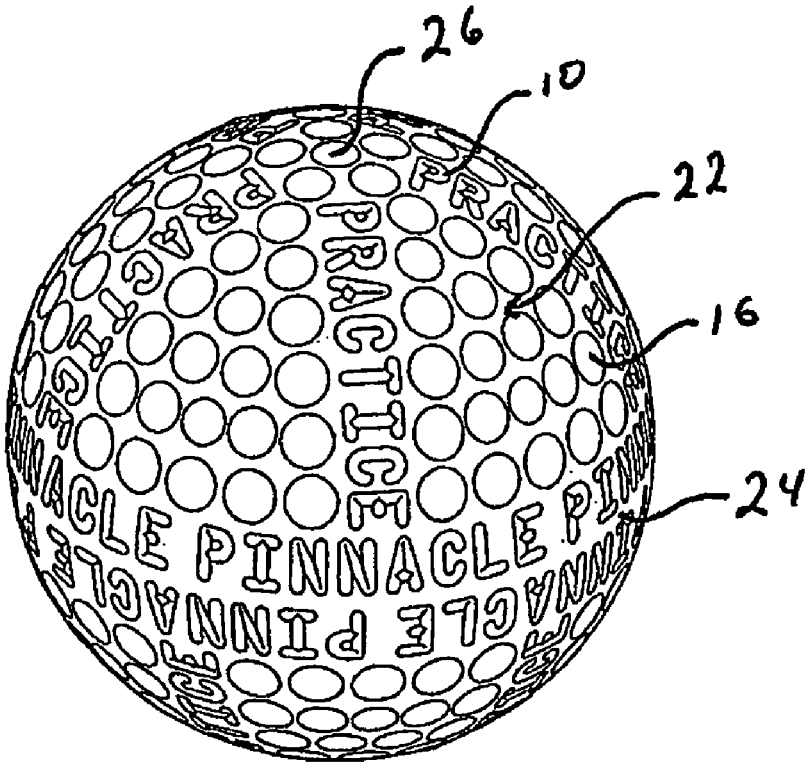
FIG. 3 is a golf ball with a plurality of text-shaped dimples forming indicia that is the boundaries of a pentagonal dipyramid dimple pattern.

FIG. 3 shows another embodiment along the same lines, except this dimple pattern is based on a pentagonal dipyramid. In this form, each hemisphere of the ball is divided into five isosceles triangles 22 with their bases along the equator 24 and their opposite vertices at the poles 26. The triangles are again delineated by words made up of strings of text-shaped dimples, but in this case each triangle has its own string along the equator side, and shares a string with neighboring triangles along the other two sides.

Other dimple arrangement schemes may employ groupings that are polygons other than triangles, such as squares, pentagons, or hexagons. For example, a dimple pattern based on a dodecahedron will usually have pentagonal groupings, and one based on a cuboctahedron will usually use a combination of squares and triangles. The same technique can be applied in these cases, where the text-shaped dimples are strung into words that form boundaries for these polygons.

Figure 4:
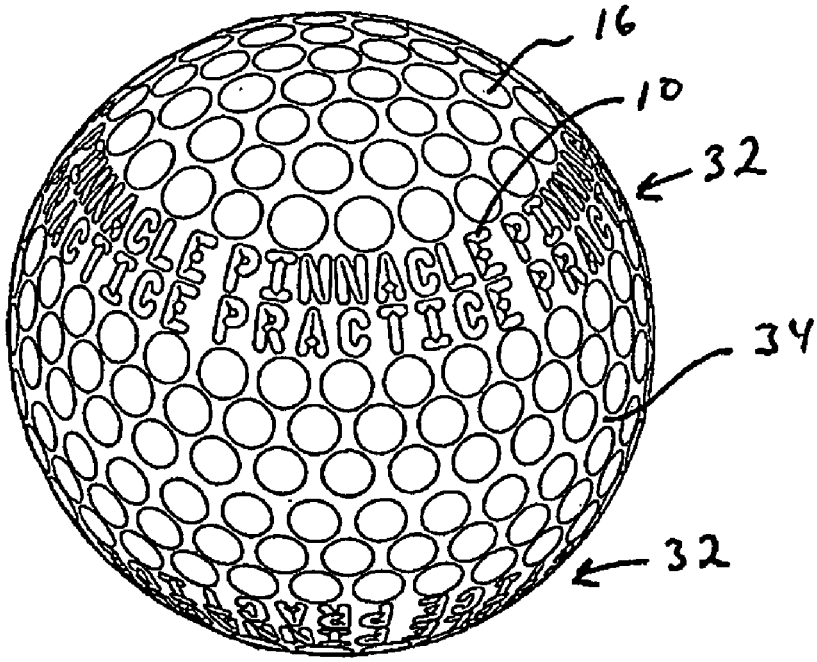
FIG. 4 is a golf ball with a plurality of text-shaped dimples forming indicia in latitudinal rows.

However, it is not necessary that the words form the boundaries of polygonal groupings of dimples. An alternative embodiment is shown in FIG. 4, which is based on a pentagonal dipyramid structure similar to that of FIG. 3. However, in this case the strings of text-shaped dimples 10 are arranged in latitudinal rows 32 parallel to the equator 34.

FIG. 5 shows an embodiment that is not based on a polyhedron at all. Rather, the surface of the ball is divided into two identical elongated areas 42 and 44, very much like the pieces that make up the cover of a baseball or tennis ball. The text-shaped dimples 10 are strung together into words along the curved path that makes up the "seam" 46 between the two cover "pieces". This provides a symmetrical and uniform distribution of the text-shaped dimples. To create more text, the same basic design could be used with more than one row of text-shaped dimples.

Figure 7:
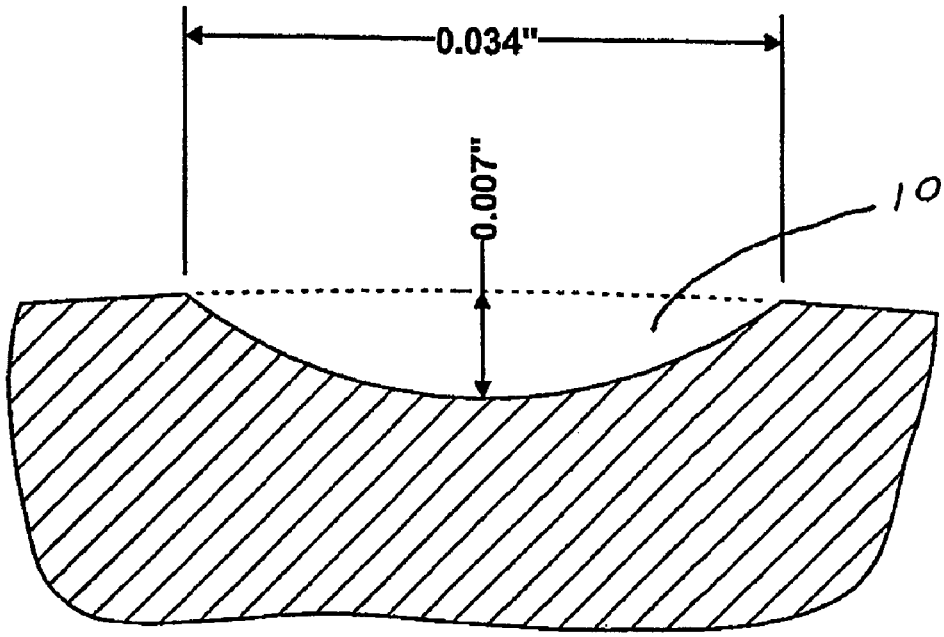
FIG. 7 is a cross-sectional view of the dimple in FIG. 6.
Figure 8:
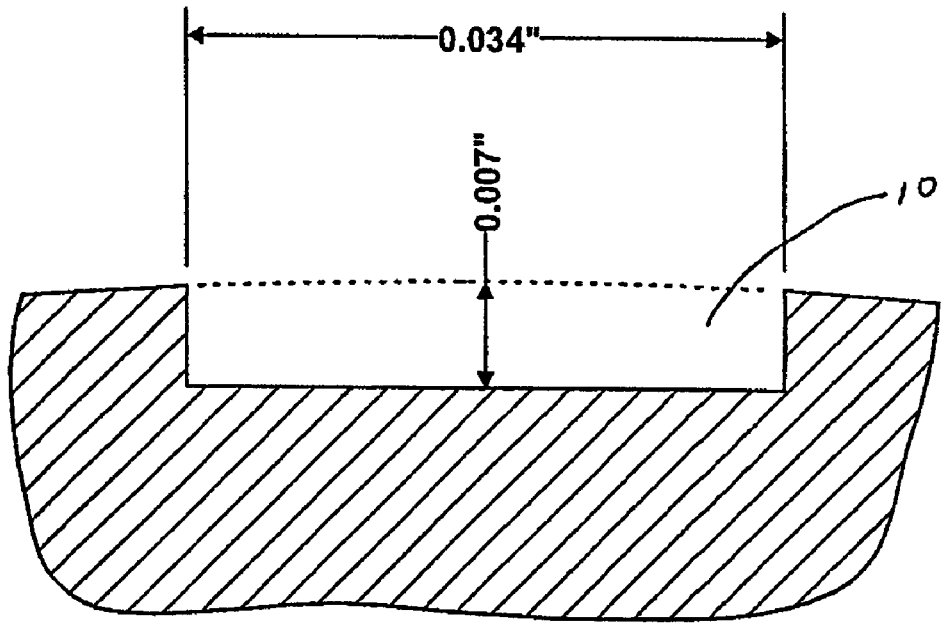
FIG. 8 is a cross-sectional view of the dimple in FIG. 6.

FIG. 6 shows a text-shaped dimple 10 having a preferred height of 0.157 inches and width of 0.096 inches. The text-shaped dimples, as stated above, are preferably about 0.08 to 0.2 inches in height and width. However, larger sized dimples may be desired in certain instances. FIGS. 7 and 8 show the cross-section AA of the dimple 10 being either rounded and square, respectively. Any cross-sectional shape can be used, but rounded is preferred. The depth of the dimple is shown at a preferred depth of 0.007 inches from the phantom surface of the ball, but should be anywhere from about 0.005 to 0.01 inches.

While various descriptions of the present invention are described above, it is understood that the various features of the present invention can be used singly or in combination thereof. For example, the golf ball can be of any construction including one-piece, two-piece, multi-layer core and/or multi-layer cover. Where the present inventive ball disclosed uses letter-shaped dimples, the invention clearly contemplates numerals and symbols and can even incorporate figures. Furthermore, preferably the indicia formed by the shaped dimples provides identification or cosmetics not obtainable with just round dimples. Therefore, this invention is not to be limited to the specifically preferred embodiments depicted therein.

What is claimed is:

1. A golf ball comprising an outer surface including a plurality of dimples that form indicia wherein the plurality of dimples take the form of text letters, characters or other symbols and occupy a substantial portion of the ball's surface in a repeating, distributed pattern.

2. The golf ball of claim 1, wherein the plurality of dimples are relatively similar in size to a plurality of conventional-shaped dimples or larger.

3. The golf ball of claim 1, wherein the plurality of dimples perform at least some of the aerodynamic functions of conventional dimples in addition to serving a cosmetic or identification function.

4. The golf ball of claim 1, wherein the plurality of dimples have a reduced aerodynamic efficiency that reduces the golf ball's carry distance.

5. The golf ball of claim 1, wherein the plurality of dimples are text-shaped depressions arranged on the golf ball in combination with conventional-shaped dimples.

6. The golf ball of claim 1, wherein the plurality of dimples are distributed such that they produce symmetrical ball flight.

7. The golf ball of claim 1, wherein the plurality of dimples are colored with ink or paint.

8. A golf ball comprising an outer surface including a plurality of dimples that form indicia wherein the plurality of dimples are about 0.08 to 0.2 inches in height and the deepest parts of the plurality of dimples is about 0.005 to 0.01 inches below a phantom surface of the ball.

9. A golf ball comprising an outer surface including a plurality of dimples that form indicia wherein the plurality of dimples are text-shaped dimples strung together into words that form boundaries of polygonal groupings of conventional dimples.

10. The golf ball of claim 9, wherein the text-shaped dimples form words delineating boundaries of triangular groupings with round or polygonal-shaped dimples therein.

11. The golf ball of claim 9, wherein the text-shaped dimples form words that form boundaries of half of triangular groupings.

12. A golf ball comprising an outer surface including a plurality of dimples that form indicia wherein the ball has a coefficient of drag that is between about 0.23 and 0.26 for a Reynolds number of 190,000 and a spin rate of 3000 rpm.

13. The golf ball of claim 12, wherein the coefficient of drag is between about 0.24 and 0.25.

14. The golf ball of claim 12, wherein the golf ball has a coefficient of lift between about 0.15 and 0.19 for a Reynolds number of 190,000 and a spin rate of 3000 rpm.

15. The golf ball of claim 14, wherein the coefficient of lift is between about 0.16 and 01.8.

* * * * *

UNITED STATES PATENT AND TRADEMARK OFFICE

CERTIFICATE OF CORRECTION

PATENT NO. : 7,303,492 B2
APPLICATION NO. : 11/191338
DATED : December 4, 2007
INVENTOR(S) : Aoyama et al.

It is certified that error appears in the above-identified patent and that said Letters Patent is hereby corrected as shown below:

Col. 8, line 11, please change "0.16 to 01.8" to -- 0.16 to 0.18 --

Signed and Sealed this

Twenty-ninth Day of April, 2008

JON W. DUDAS
*Director of the United States Patent and Trademark Office*